US007240650B2

(12) United States Patent
Imaizumi et al.

(10) Patent No.: US 7,240,650 B2
(45) Date of Patent: Jul. 10, 2007

(54) VALVE TIMING ADJUSTING APPARATUS

(75) Inventors: Tatsuhiko Imaizumi, Kariya (JP); Kinya Takahashi, Obu (JP); Tomonari Chiba, Nishikamo-gun (JP)

(73) Assignee: DENSO Corporation, Kariya, Aichi-pref. (JP)

( * ) Notice: Subject to any disclaimer, the term of this patent is extended or adjusted under 35 U.S.C. 154(b) by 300 days.

(21) Appl. No.: 10/992,096

(22) Filed: Nov. 19, 2004

(65) Prior Publication Data

US 2005/0115528 A1 Jun. 2, 2005

(30) Foreign Application Priority Data

Nov. 20, 2003 (JP) ..... 2003-391238

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18, 90.27, 90.31; 464/1, 464/2, 160
See application file for complete search history.

(56) References Cited

U.S. PATENT DOCUMENTS 5,960,757 A 10/1999 Ushida
6,006,709 A 12/1999 Ushida
6,155,221 A 12/2000 Ushida
6,199,524 B1 3/2001 Ushida
7,100,555 B2 * 9/2006 Imaizumi et al. ..... 123/90.17

FOREIGN PATENT DOCUMENTS

WO WO 99/05411 2/1999

* cited by examiner

*Primary Examiner*—Ching Chang
(74) *Attorney, Agent, or Firm*—Nixon & Vanderhye P.C.

(57) ABSTRACT

A valve timing adjusting apparatus for an engine comprises a housing unit and a vane rotor rotatably housed in the housing unit. The housing unit comprises a front plate, a shoe housing and a sprocket, wherein those elements are fixed to each other. A position determination pin is inserted through a through hole formed in the shoe housing and into a tapered hole formed in the sprocket, to position the shoe housing at a desired position with respect to the sprocket. Since a forward end of the position determination pin is brought into contact with an inner surface of the tapered hole, the positioning of the shoe housing with respect to the sprocket can be surely attained.

6 Claims, 6 Drawing Sheets

VALVE TIMING ADJUSTING APPARATUS

CROSS REFERENCE TO RELATED APPLICATION

This application is based on Japanese Patent Application No. 2003-391238 filed on Nov. 20, 2003, the disclosures of which is incorporated herein by reference.

FIELD OF THE INVENTION

The present invention relates to a compound structure having two members, in which a position of one member is determined by a position determination member, and relates to a method of assembling the compound structure. The present invention particularly relates to a valve timing adjusting apparatus for an internal combustion engine, in which an opening and closing timing of intake and exhaust valves are adjusted.

BACKGROUND OF THE INVENTION

In Japanese Patent Publication No. H9-60508, a compound structure is disclosed, in which a position of a sprocket to a shoe housing is determined by a position determination member. Japanese Patent Publication No. H9-60508 further discloses an apparatus for adjusting a valve opening and closing timing of an engine, in which a vane rotor is rotated relative to the shoe housing and the sprocket.

An apparatus shown in FIG. 8 is known as an apparatus for adjusting a valve (opening and closing) timing of an engine exhaust valve, in which the valve timing is adjusted by an oil pressure. In the apparatus shown in FIG. 8, when the engine is started in a severe application environment, operation oil mixed with air may be supplied to an oil-pressure chamber facing a vane rotor 1. In such a case, since dry dusting of a shoe housing 3 is carried out by the vane rotor 1 to which a torque of a cam shaft is applied, a knock pin 6 of a cylindrical rod shape is used as a position determination member to prevent a bolt for tightening a sprocket 4 to the shoe housing 3 from being loosened by the dusting.

In addition, in the apparatus shown in FIG. 8, a stopper piston 7 is provided to hold the vane rotor 1 at its most advanced position relative to the sprocket 4 right after the start of the engine. Namely, the stopper piston 7 is accommodated in the vane rotor 1 in a reciprocally movable manner, and a forward end 7*a* of the stopper piston 7 is inserted into a bush 9 of the sprocket 4 by a biasing force of a coil spring 8, so that a relative rotation between the rotor vane 1 and the sprocket 4 is prevented.

In the apparatus shown in FIG. 8, the forward end 7*a* of the stopper piston 7 is designed into a straight shape and the forward end 7*a* is positioned with a high degree of precision relative to the bush 9 so that, in a state of holding the rotational phase, the stopper piston 7 is not removed from the bush 9 due to a positive torque received from a cam shaft. For this reason, in a process of assembling the apparatus, the sprocket 4 is fixed to the shoe housing 3 by bolts by precise adjustment of a clearance between the forward end 7*a* of the stopper piston 7 and the bush 9. Due to a manufacturing tolerance in such assembling process, a hole 3*a* provided in the shoe housing 3 and a hole 4*a* provided in the sprocket 4 for inserting the knock pin 6 are mutually eccentric. In this case, since the knock pin 6 is no longer placed correctly, a positioning capability by the knock pin 6 is deteriorated. If each diameter of the holes 3*a* and 4*a* is made larger in anticipation of the manufacturing tolerance, the knock pin 6 is prone to saccadic movements. And thereby, the positioning capability by the knock pin 6 is likewise deteriorated.

Furthermore, in the apparatus shown in FIG. 8, when the knock pin 6 is inserted into the holes 3*a* and 4*a* of the shoe housing 3 and the sprocket 4, a hermetically sealed space is formed at a forward end of the knock pin 6. Since the air in the sealed space is compressed, variation of insertion depth of the knock pin 6 may occur due to a damper effect of the air in the sealed space. Such variation is not desirable, because it also deteriorates the positioning capability.

SUMMARY OF THE INVENTION

It is, therefore, an object of the present invention to provide a compound structure for maintaining a characteristic of a positioning capability using a position determination member and a method for assembling the compound structure.

According to a feature of the present invention, a valve timing adjusting apparatus for an engine comprises; a housing unit being composed of a front plate, a shoe housing and a sprocket; and a vane rotor rotatably housed in the housing unit so that the vane rotor can be rotated relative to the housing unit within a limited angle. In the above apparatus, a through hole is formed in the shoe housing and a tapered hole is formed in the sprocket, and a position determination pin is inserted into the through hole and then into the tapered hole, so that a forward end of the position determination pin is brought into contact with an inner surface of the tapered hole.

According to another feature of the invention, one end of the through hole faces to an opening of the tapered hole, wherein a diameter of the opening is made larger than a diameter of the through hole.

According to a further feature of the invention, the forward end of the position determination pin is formed into a taper shape having a taper angle almost equal to that of the tapered hole.

According to a further feature of the invention, the forward end of the position determination pin is brought into contact with the inner surface of the tapered hole, so that a component force is generated at a contact point between the forward end and the inner surface to urge the shoe housing in a retarding direction with respect to the sprocket.

According to a further feature of the invention, the tapered hole is formed of a bottomed hole, and a connection hole is formed between the shoe housing and the sprocket for communicating a space formed by the bottomed hole with a space formed by the shoe housing and the sprocket, in which the vane rotor is rotatably accommodated.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

An embodiment of the present invention is explained with reference to the drawings.

Figure 2:
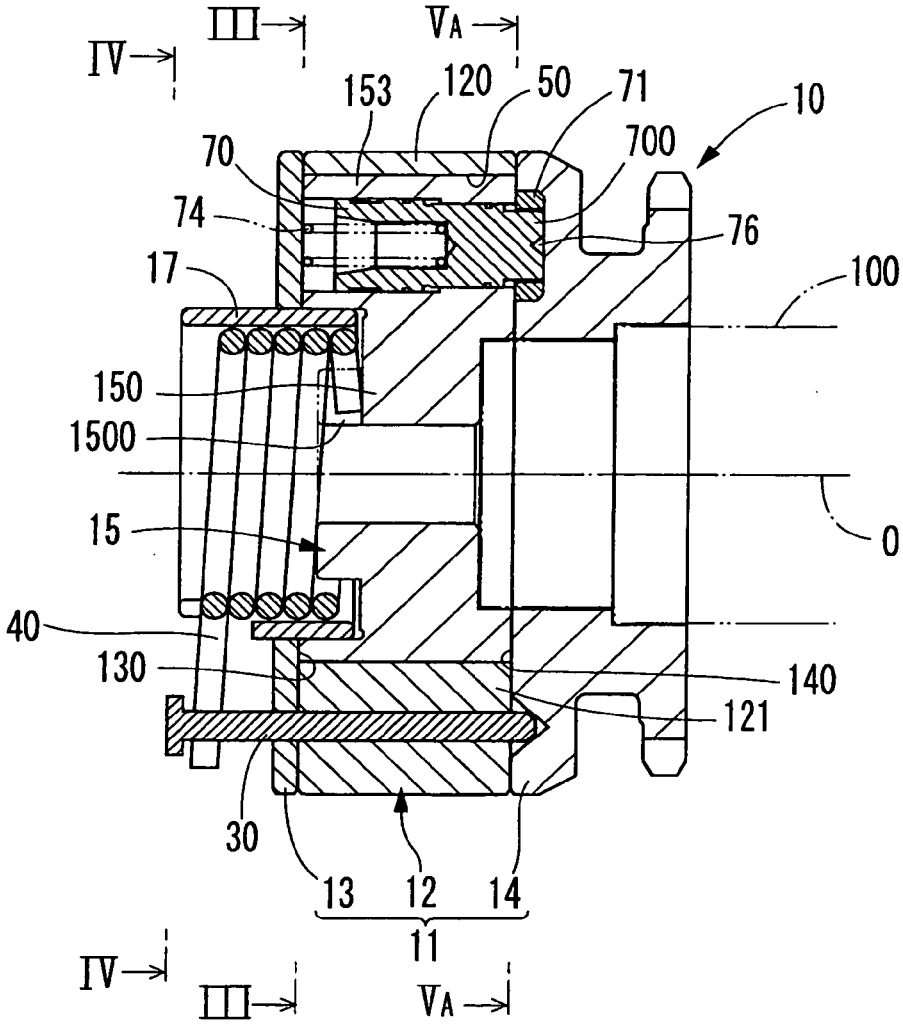
FIG. 2 is a cross-sectional view taken along a line II—II shown in FIG. 3.
Figure 3:
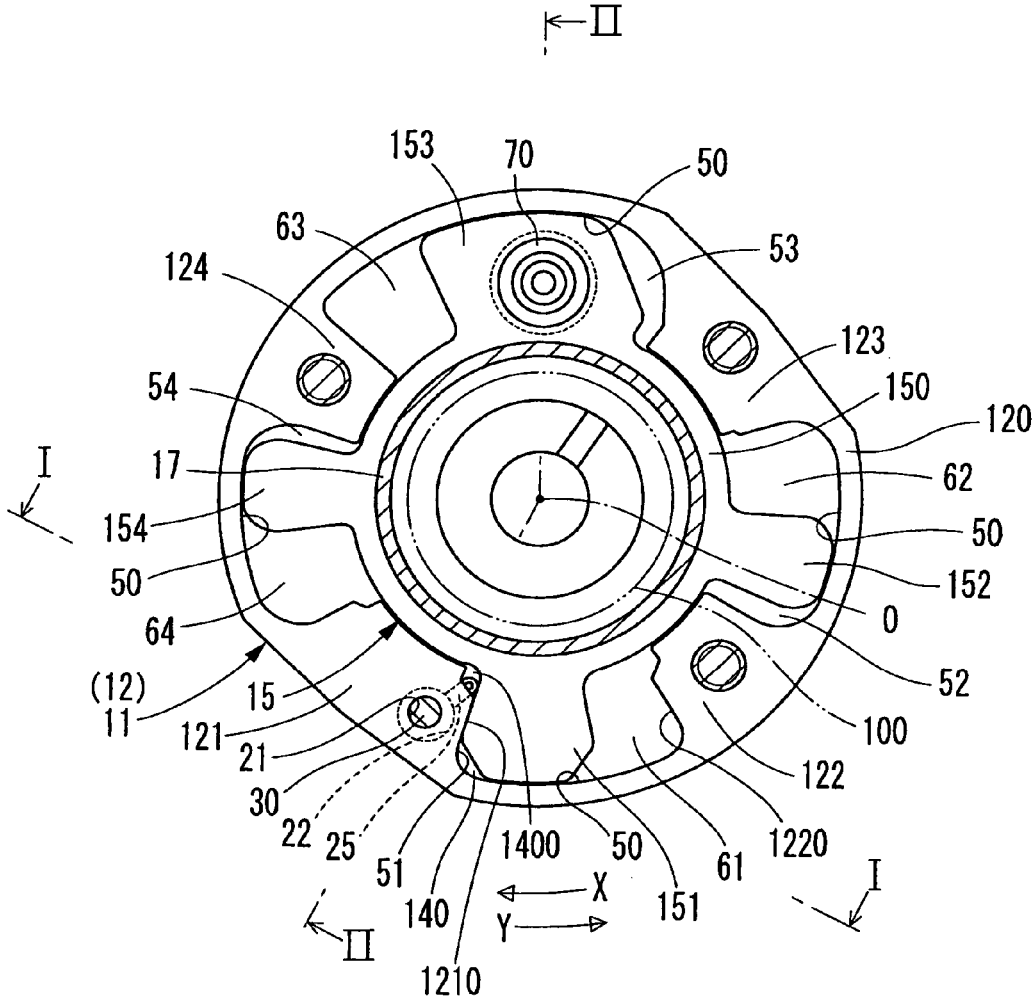
FIG. 3 is a cross-sectional view taken along a line III—III shown in FIG. 2.

A valve timing adjustment apparatus according to an embodiment of the present invention is shown in FIGS. 2 and 3. The valve timing adjustment apparatus 10 is provided in a torque transmitting system for transmitting a driving torque generated at a crank shaft of an engine to a cam shaft 100 of the engine. The valve timing adjustment apparatus 10 is an oil-pressure apparatus for adjusting a valve timing of an exhaust valve by using an oil pressure. As a compound structure, the valve timing adjustment apparatus 10 has a plurality of members including those designated by reference numerals 12 to 15, 17, 30, 40, 70, 71 and 74.

A housing unit 11 comprises a shoe housing 12, a front plate 13 and a sprocket 14, to form a space therein for accommodating a vane rotor 15*a* as a rotary member.

The sprocket 14 is provided at an outer periphery of the cam shaft 100 so that the sprocket 14 can rotate relative to the cam shaft 100. A chain belt is put on between the sprocket 14 and the crank shaft (not shown). A driving torque transmitted from the crank shaft to the sprocket 14 through the chain belt rotates the sprocket 14 synchronously with the crank shaft. A rotational direction of the sprocket 14 is the clockwise direction in FIG. 3.

The shoe housing 12 and the front plate 13 are fixed to the sprocket 14 by bolts, wherein the shoe housing 12 is sandwiched between the front plate 13 and the sprocket 14. In this embodiment, the sprocket 14 is positioned with respect to the shoe housing 12 and the front plate 13 by a position determination pin 30, which is used as a position determination member. According to the above structure, the shoe housing 12, the front plate 13 and the sprocket 14 is rotated as a single body, while a relative rotation between the sprocket 4 and the cam shaft 100 is maintained. A cylindrical retainer 17 is inserted into the inner circumference side of the front plate 13 of a disc-plate shape, in such a manner that the cylindrical retainer 17 can rotate relative to the front plate 13.

The shoe housing 12 has a main body 120 and a plurality of shoes 121, 122, 123 and 124. The main body 120 is formed into a cylindrical shape and provided concentrically with respect to the front plate 13 and the sprocket 14. The shoes 121, 122, 123 and 124 protrude in the inward radial direction of the main body 120 from four locations separated away from each other at intervals in the rotational direction of the main body 120. Each of protruding end surfaces of the shoes 121, 122, 123 and 124 has an arc shape in its cross section and is brought into contact with an outer surface of a rotor body 150 of the vane rotor 15 in such a way that the protruding end surface slide on the outer surface. Spaces between the adjacent two shoes 121, 122, 123 and 124 form a plurality of accommodation chambers 50. The accommodation chambers 50 are surrounded by the shoes 121, 122, 123 and 124, the main body 120, the front plate 13 and the sprocket 14 to form a cross section having a fan-like shape.

A surface of each axial end of the vane rotor 15 is respectively brought into contact with a surface 140 of the sprocket 14 and a surface 130 of the front plate 13 (on the surface of the shoe housing 12), so that the axial ends of the vane rotor 15 can be slidable over the surfaces 140 and 130. The vane rotor 15 has the rotor body 150 and a plurality of vanes 151, 152, 153 and 154. The rotor body 150 is connected to the cam shaft 100 concentrically by a bolt. Thus, the vane rotor 15 and the cam shaft 100 can be rotated as a single body in the housing unit 11. An arrow X in FIG. 3 (and FIG. 1) represents a direction in which a movement of the vane rotor 15 is advanced relative to the housing unit 11, whereas an arrow Y represents a direction in which the movement of the vane rotor 15 is retarded relative to the housing unit 11.

The vanes 151, 152, 153 and 154 protrude in an outward radial direction from four locations separated away from each other at intervals in the rotational direction of the vane rotor 15 and are accommodated in their respective accommodation chambers 50. Each protruding end surface of the shoes 121, 122, 123 and 124 has an arc shape in its cross section and is brought into contact with an inner surface of the main body 120, so that the protruding end surface can be slidable over the inner surface of the main body 120. The vanes 151, 152, 153 and 154 divide their respective accommodation chambers 50 into two chambers, to form retarding oil chambers 51, 52, 53 and 54 and advancing oil chambers 61, 62, 63 and 64.

When an operation oil is supplied to the retarding oil chambers 51 to 54 from an oil-pressure pump (not shown), an operation oil is drained from the advancing oil chambers 61 to 64. On the other hand, when the operation oil is supplied to the advancing oil chambers 61 to 64, the operation oil is drained from the retarding oil chambers 51 to 54. A switching valve (not shown) is provided to control the supply of the operation oil to either the retarding oil chambers or the advancing oil chambers. Thus the position of the vane rotor 15 (relative to the housing unit 11) is determined by the balance of the oil pressure between the retarding oil chambers 51 to 54 and the advancing oil chambers 61 to 64.

A rotational range of the vane rotor 15 (relative to the housing unit 11) is limited to a predetermined angle. As shown in FIG. 3, the rotation of the vane rotor 15 in the advancing direction X is limited by a position at which the vane 151 is brought into contact with a surface portion 1210 of the shoe 121 (facing in the retarding direction Y). That is, the surface portion 1210 functions as a stopper of the rotation of the vane rotor 15 to prescribe the most advanced position (relative to the housing unit 11) of the vane rotor 15. On the other hand, the rotation of the vane rotor 15 in the retarding direction Y is likewise limited by a position at which the vane 151 is brought into contact with a surface portion 1220 of the shoe 122 (facing in the advancing direction X). That is, the surface portion 1220 functions as a stopper of the rotation of the vane rotor 15 to prescribe the most retarded position (relative to the housing unit 11) of the vane rotor 15.

Figure 4:
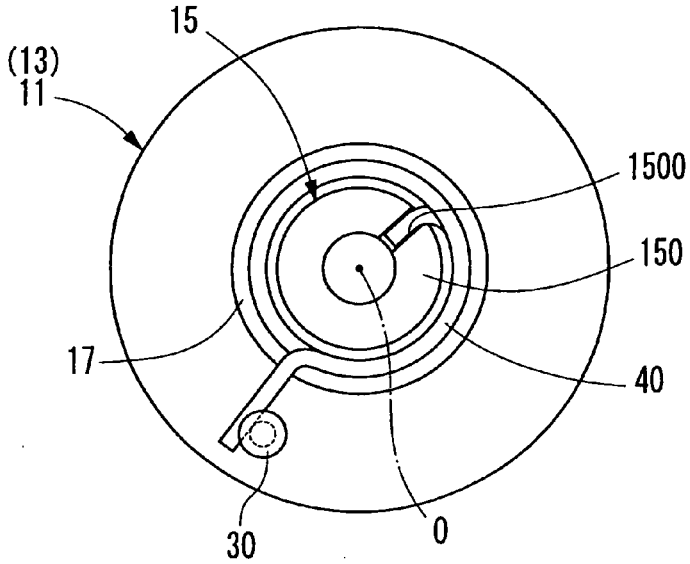
FIG. 4 is a cross-sectional view taken along a line IV—IV shown in FIG. 2.

As shown in FIGS. 2 and 4, a torsion spring 40 is provided in a cylindrical retainer 17, as a biasing member. One end of the torsion spring 40 is engaged with and held by the position determination pin 30, whereas the other end of the torsion spring 40 is engaged in and held by a dent 1500 of the rotor body 150. A restoring force of the torsion spring 40 works as a bias torque for biasing the vane rotor 15 in the advancing direction X, relative to the housing unit 11 into which the position determination pin 30 is inserted. The restoring force of the torsion spring 40 reaches a maximum value when the vane rotor 15 is located at the most retarded position with respect to the housing unit 11. The more the vane rotor 15 is rotated in the advancing direction X, the smaller the restoring force of the torsion spring 40. In addition, the restoring force of the torsion spring 40 is always larger than an average positive torque applied to the cam shaft 100 from the exhaust valve. The average positive torque applied to the cam shaft 100 from the exhaust valve is a torque in a direction to drive the vane rotor 15 in the retarding direction Y.

As shown in FIGS. 2 and 3, a stopper piston 70 is formed into a cylindrical shape having a bottom and is accommodated in the vane rotor 15 eccentrically with respect to a rotation-center shaft O of the vane rotor 15. The vane 153 supports the stopper piston 70 in such a way that the stopper piston 70 can be reciprocally moved. A bush 71 is formed into a circular shape and fixed by a pressure into a dent formed on the sprocket 14. When the vane rotor 15 is located at the most advanced position relative to the housing unit 11 as shown in FIG. 3, a forward end 700 of the stopper piston 70 is engaged with the bush 71 as shown in FIG. 2. An inner circumferential surface of the bush 71 and an outer circumferential surface of the forward end 700 are formed with straight cylindrical surfaces having an approximately uniform diameter. A piston oil-pressure chamber 76 is formed between the bush 71, the sprocket 14 and the stopper piston 70, and is communicated to the retarding oil chamber 53. The oil pressure of operation oil supplied to the piston oil-pressure chamber 76 from the retarding oil chamber 53 works in the direction in which the stopper piston 70 departs from the bush 71. One end of a coil spring 74 is engaged with and held by the front plate 13, whereas the other end of the coil spring 74 is engaged with and held by the stopper piston 70. The coil spring 74 generates a bias force to bias the stopper piston 70 toward the bush 71.

Next, a structure of positioning the housing unit 11 by the position determination pin 30 is explained.

Figure 1:
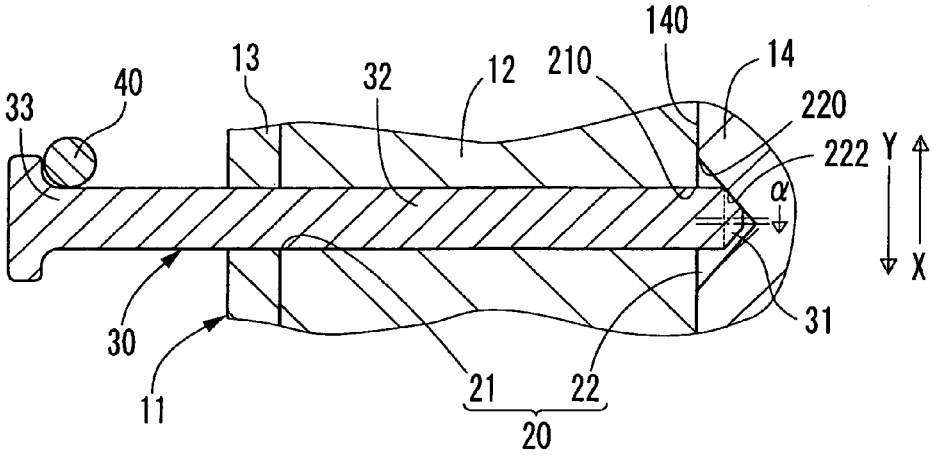
FIG. 1 is an enlarged cross-sectional view taken along a line I—I shown in FIG. 3, partly showing a valve timing adjustment apparatus according to an embodiment of the present invention.

As shown in FIG. 1, an insertion hole 20 for inserting the position determination pin 30 is formed in the housing unit 11. The insertion hole 20 comprises a through hole 21, which penetrates both the front plate 13 and the shoe housing 12, and a bottomed hole 22 provided on the surface 140 of the sprocket 14.

The through hole 21 is a cylindrical hole having an approximately uniform diameter in the axial direction. The through hole 21 is eccentric with respect to the rotation-center shaft O of the shoe housing 12 and the front plate 13 (Refer to FIG. 3). The bottomed hole 22 is a taper hole with a diameter decreasing in a direction from the opening side to the bottom and eccentric with respect to the rotation-center shaft O of the sprocket 14. An opening 220 (having a largest diameter in the bottomed hole 22) of the bottomed hole 22 and an opening 210 (on the side of the sprocket 14) of the through hole 21 face to each other eccentrically. The eccentric direction. (relative to the through hole 21) of the bottomed hole 22 approximately coincides with the retarding direction Y.

In the embodiment described above, in conjunction with the front plate 13, the shoe housing 12 forms a first member having the through hole 21, whereas the sprocket 14 forms a second member having the bottomed hole 22, which is the taper hole.

Figure 5A:
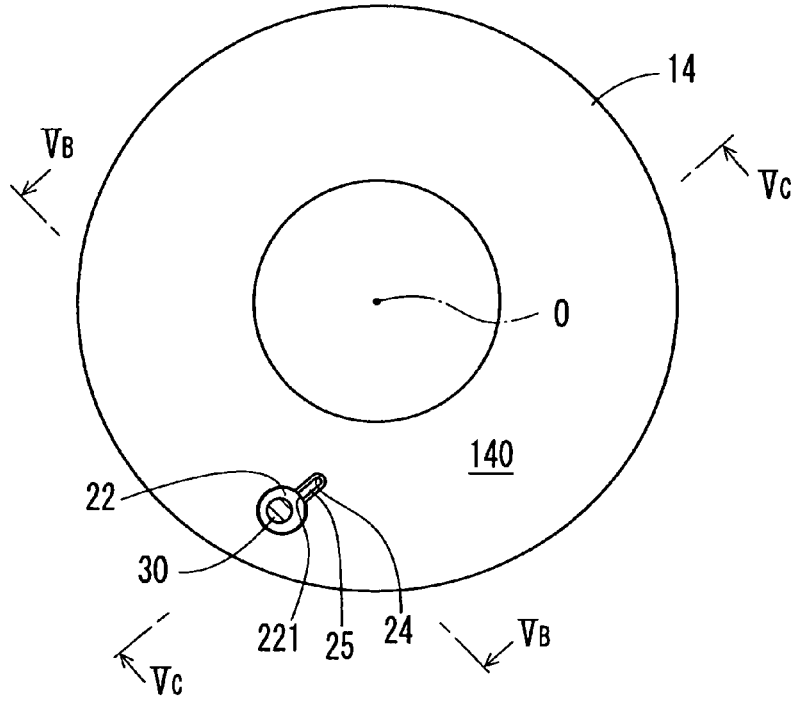
FIG. 5A is a cross-sectional view taken along a line VA—VA shown in FIG. 2.
Figure 5B:
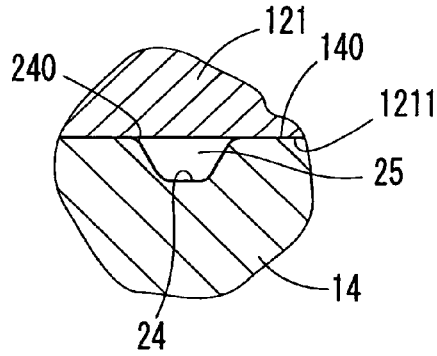
FIG. 5B is a cross-sectional view taken along a line VB—VB shown in FIG. 5A.
Figure 5C:
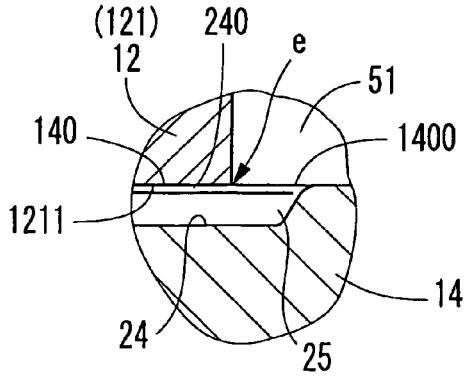
FIG. 5C is a cross-sectional view taken along a line VC—VC shown in FIG. 5A.

The surface 140 of the sprocket 14 is an interface serving as a boundary with the shoe housing 12. As shown in FIGS. 5A, 5B and 5C, a groove 24 is formed on the surface 140. An opening 240 of the groove 24 is covered by a surface portion 1211 (on the side of the sprocket 14) of the shoe 121 to form a connection hole 25 between the groove 24 and the surface portion 1211. One end of the connection hole 25 is exposed to an internal-face portion 221 (on the side of the rotation-center shaft O) of the bottomed hole 22. The internal-face portion 221 is a portion of an inner surface of the bottomed hole 22. This inner surface (internal-face portion) is not in contact with the position determination pin 30.

As shown in FIGS. 3 and 5C, the other end of the connection hole 25 is exposed to a partial face 1400 of the surface 140 of the sprocket 14. The partial face 1400 is a portion not in contact with the vane rotor 15. According to the above structure, the connection hole 25 communicates the insertion hole 20 (a space formed by the bottomed hole 22) with the retarding oil chamber 51 at a shortest distance.

As shown in FIG. 5C, since the retarding oil chamber 51 is in contact with an edge "e" of an interface between the shoe housing 12 and the sprocket 14, the operation oil supplied to the retarding oil chamber 51 may be spread over the interface between the shoe housing 12 and the sprocket 14 and may reach the insertion hole 20. However, the operation oil arriving at the insertion hole 20 can be returned to the retarding oil chamber 51 through the connection hole 25. And therefore, the operation oil does not leak out from the valve timing adjustment apparatus 10, and the liquid-sealing characteristic is assured.

As shown in FIG. 1, the position determination pin 30 is a pin formed into a rod-like shape and inserted into the insertion hole 20. The position determination pin 30 has a contact portion (a forward end) 31, a pressed-in portion 32 and a holding portion 33, which are arranged sequentially from the forward end of the position determination pin 30. The pressed-in portion 32 is formed into a cylindrical shape having an approximately uniform diameter in the axial direction. A portion of the pressed-in portion 32 is inserted into the through hole 21 by a pressure.

The contact portion 31 is formed into a taper shape with a diameter decreasing in a direction from the side of the pressed-in portion 32 to the forward end. The diameter (on the side of the pressed-in portion 32) of the contact portion 31 (that is, the maximum diameter of the contact portion 31) is about equal to the external diameter of the pressed-in portion 32 but smaller than the internal diameter of the opening 220 of the bottomed hole 22. The taper angle of the contact portion 31 is set at a value about equal to the taper angle of the bottomed hole 22. The length of the generating line of the contact portion 31 is smaller than the length of the generating line of the bottomed hole 22. The contact portion 31 having such a configuration is brought into contact with an internal-face portion 222 on the generating line. The internal-face portion 222 is a portion of an inner surface (facing in the retarding direction Y) of the bottomed hole 22.

The holding portion 33 of the position determination pin 30 is also formed into a cylindrical shape having a step on the opposite side of the forward end. The holding portion 33 is a means engaged with the torsion spring 40 to hold the torsion spring 40.

Next, an operation of the valve timing adjustment apparatus 10 is explained.

During the engine is stopped, no operation oil is supplied to the retarding oil chambers 51 to 54, the advancing oil chambers 61 to 64, and the piston oil-pressure chamber 76. The vane rotor 15 is thereby held at its most advanced position relative to the housing unit 11 by the bias force of the torsion spring 40, at which the further rotation of the vane rotor 15 in the advancing direction is limited by the surface portion 1210 of the shoe 121, and the stopper piston 70 is inserted into the bush 71.

When the engine is started, an operation of supplying the operation oil to the retarding and advancing oil chambers 51 to 54 and 61 to 64 starts. The stopper piston 70 is kept at its position by the biasing force of the spring 74 (at which it is inserted into the bush 71), until the operation oil is sufficiently supplied to the piston oil-pressure chamber 76 from the retarding oil chamber 53. As above, the vane rotor 15 is held at its most advanced position until then.

When the operation oil is sufficiently supplied to the piston oil-pressure chamber 76, the stopper piston 70 is separated away from the bush 71, so that the vane rotor 15 can be rotated relative to the housing unit 11. The vane rotor 15 is rotated depending on a pressure balance between the those in the retarding and advancing oil chambers, and as a result, the rotational phase (relative to the crank shaft) of the cam shaft 100 is changed.

When the valve timing adjusting apparatus is used in a severe operational environment, such as a low-temperature environment, the operation oil mixed with air may, in some cases, be supplied to the retarding and advancing oil chambers 51 to 54 and 61 to 64. In such cases, so-called a dry dusting may occur, in which the vane 151 repeatedly collides against the surface portion 1210 of the shoe 121, because of toque variations applied to the cam shaft 100 from the exhaust valve.

Due to the dry dusting, the shoe housing 12 and the front plate 13 attempt to make a rotation relative to the sprocket 14 in the advancing direction X. In other words, the sprocket 14 attempts to make a rotation relative to the shoe housing 12 and the front plate 13 in the retarding direction Y.

According to the present invention, however, the contact portion 31 of the position determination pin 30 is brought into contact with the internal-face portion 222 (facing in the retarding direction Y) of the bottomed hole 22, to prevent the sprocket 14 from rotating in the retarding direction Y relative to the shoe housing 12 and the front plate 13.

Since the contact portion 31 is brought into contact with the internal-face portion 222 of the bottomed hole 22 along the entire generating line, a stable performance of the positioning can be attained. In addition, in this embodiment, the through hole 21 penetrates in the vicinity of the surface portion 1210 (against which the vane 151 collides) of the shoe 121, and the position determination pin 30 is inserted into the through hole 21. Thus, when the vane 151 collides against the surface portion 1210, a torque urging the shoe housing 12 to rotate the same relative to the sprocket 14 with the position determination pin 30 taken as a support point decreases. Thus, a positional shift caused by such a torque as a shift between the shoe housing 12 and the sprocket 14 can be avoided.

Figure 6:
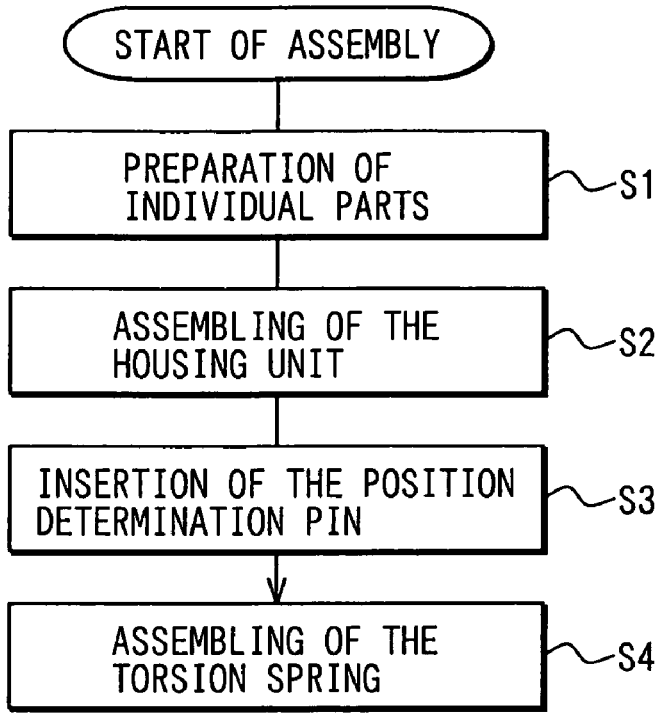
FIG. 6 is a flow chart for assembling the valve timing adjusting apparatus.

Next, a method to assemble the valve timing adjustment apparatus 10 is explained by referring to a flowchart shown in FIG. 6.

First of all, at a step S1, a plurality of members composing the valve timing adjustment apparatus 10 are prepared individually. As this step, holes are respectively formed in the shoe housing 12 and the front plate 13, which form the through hole 21 when they are assembled together. The bottomed hole 22 and the groove 24 are formed on the sprocket 14, and the bush 71 is fixed by a pressure into the dent formed on the sprocket 14. The stopper piston 70 and the coil spring 74 are assembled in the vane rotor 15. The contact portion 31, the pressed-in portion 32 and the holding portion 33 are prepared to form the position determination pin 30.

Then, at a step S2, the shoe housing 12, the front plate 13 and the sprocket 14, which are members of the housing unit 11 accommodating the vane rotor 15, are assembled to form the housing unit 11. In this step S2, a clearance between the forward end 700 of the stopper piston 70 and the bush 71 is adjusted by moving the members 12, 13, 14 and 15 in a range, in which the opening (on the side of the sprocket 14) of the through hole 21 of the shoe housing 12 and the opening 220 of the bottomed hole 22 of the sprocket 14 face to each other. Then, those members are tightly fixed to each other by bolts, at a position at which a desired clearance is achieved. As a result, the insertion hole 20 is formed, wherein the bottomed hole 22 is eccentric with respect to the insertion hole in the retarding direction Y. In addition, the connection hole 25 is formed, which consists of the groove 24 of the sprocket 14 and the surface portion 1211 of the shoe 121. The connection hole 25 communicates the retarding oil chamber 51 to the insertion hole 20 (the space formed by the bottomed hole 22), which are exposed to the atmosphere in the course of the assembling process. Furthermore, the retarding and advancing oil chambers 51 to 54 and 61 to 64 are respectively formed in the accommodation chambers 50.

At a step S3, the position determination pin 30 is inserted sequentially into the through hole 21 and bottomed hole 22 of the insertion hole 20. In this step S3, a constant pressure is applied to the position determination pin 30, until the contact portion 31 of the position determination pin 30 is brought into contact with the inner surface of the bottomed hole 22. In this insertion process, a contact point between the contact portion 31 and the inner surface can be detected by monitoring the pressure applied to the position determination pin 30. As a result, the contact portion 31 is brought into contact with the internal-face portion 222 (facing the retarding direction Y) of the bottomed hole 22 along its generating line.

Finally, at a step S4, the torsion spring 40 is assembled in the retainer 17, so that one end of the torsion spring 40 is engaged with and held by the holding portion 33 of the position determination pin 30, whereas the other end of the torsion spring 40 is being engaged with and held by the dent 1500 of the vane rotor 15.

The valve timing adjustment apparatus 10 assembled in this way is then mounted to the engine, wherein the vane rotor 15 is fixed to the cam shaft 100 by bolts.

In accordance with the method described above, at the step S2, the shoe housing 12 and the front plate 13 are fixed to the sprocket 14, wherein the through hole 21 and the bottomed hole 22 are mutually eccentric. At the step S3, however, the position determination pin 30 is assembled at such a position, at which the contact portion 31 is brought into contact with the internal-face portion 222 of the bottomed hole 22 corresponding to the amount of eccentricity between the through hole 21 and the bottomed hole 22. Accordingly, a displacement between the through hole 21 and the bottomed hole 22 can be absorbed.

In addition, at the step S3, the contact portion 31 and the internal-face portion 222, which have about equal taper angles, are brought into contact with each other over a long segment in the direction of the generating line. Thus, the stable characteristic of a positioning capability by the position determination pin 30 can be obtained.

In addition, at the step S3, since the pressed-in portion 32 is inserted into the through hole 21 and firmly held by the through hole 21, the position determination pin 30 is hardly shifted in the axial direction. Since a simple pressure-based insertion structure can be used for preventing the position determination pin 30 from being shifted in the axial direction, the positioning characteristic by the position determination pin 30 can be improved at a low cost.

In addition, at the step S3, the position determination pin 30 is inserted into the through hole 21 and the bottomed hole 22, which is communicated to the atmosphere through the connection hole 25 during this assembling process. And therefore, the air in the bottomed hole 22 can be exhausted into the atmosphere. In particular, since the connection hole 25 is formed at the shortest distance in this embodiment, the air emission into the atmosphere can be performed much easily, due to a lower flow resistance. As a result, a damping operation by compressed air in the bottomed hole 22 is prevented, to further improve the positioning characteristic.

Furthermore, at the step S2, the connection hole 25 is formed by assembling the shoe housing 12 and the sprocket 14, with the groove 24 of the sprocket 14 and the surface portion 1211 of the shoe 121. As above, the connection hole 25 can be easily formed.

In addition, the end of the connection hole 25 is terminated at the internal-face portion 221 (which is the portion of the inner surface not in contact with the position determination pin 30) of the bottomed hole 22. And therefore, even if a flash or burr remained at the terminated end of the connection hole 25, they would not affect a smooth contact between the contact portion 31 of the pin 30 and the internal-face portion 222 of the bottomed hole 22 along the generating line. As a result, the position determination pin 30 can be prevented from entering an unstable state due to such flash or burr.

In addition, the other end of the connection hole 25 is terminated at the partial face 1400 (which is not in contact with the vane rotor 15) of the surface 140 of the sprocket 14. And therefore, even if a flash or burr likewise remained at the opening edge (on the side of the retarding oil chamber) of the connection hole 25, a rotation made by the vane rotor 15 relative to the housing unit 11 can be prevented from being obstructed by such flash or burr.

A modification of the above embodiment will be explained with reference to FIG. 7.

Figure 7:
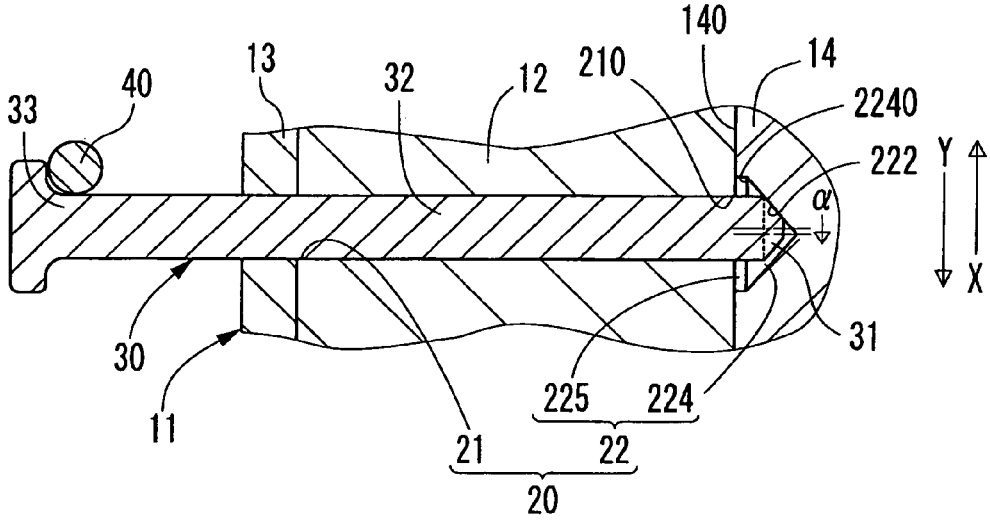
FIG. 7 is a cross-sectional view of the valve timing adjusting apparatus according to a modification of the present invention, corresponding to the view of FIG. 1.
Figure 8:
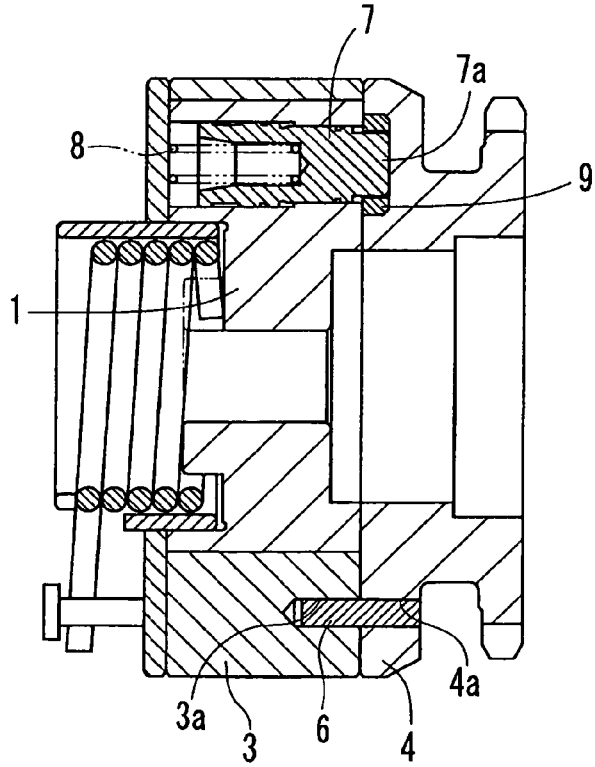
FIG. 8 PRIOR ART
FIG. 8 is a cross-sectional view of a prior art valve timing adjusting apparatus.

In the modification of FIG. 7, the bottomed hole 22 is formed of a tapered hole 224 and a straight hole 225 on the through hole side of the tapered hole 224. The bottomed hole 22 has an opening 2240 at the straight hole 225 having a largest diameter. The valve timing adjusting apparatus having the bottomed hole 22 of FIG. 7 has the same effect to that of FIG. 1.

In addition, in the above embodiment, the position determination pin 30 is firmly held in the shoe housing 12 by a press fitting between the pressed-in portion 32 and the through hole 21. The axial movement of the position determination pin 30 can be, however, limited by another limiting means, such as a pin. A screwed portion can be formed on an outer periphery of the position determination pin 30 as another alternative, and the pin 30 can be screwed into the through hole 21.

Furthermore, in the above embodiment, the constant pressure is applied to the position determination pin 30 so that it is pressed into the through hole 21, and the insertion of the pin to the desired depth is detected by monitoring the pressure at the position determination pin 30. As an alternative method, however, data of multiple insertion processes are accumulated, and a parameter for determining whether the position determination pin 30 is inserted to the desired depth can be selected.

Furthermore, in the above embodiment, the contact portion 31 of the position determination pin 30 is formed into the taper shape having the same taper angle to that of the tapered hole of the bottomed hole 22 and the diameter of the contact portion 31 is made smaller than the diameter of the opening 220 of the bottomed hole 22. The taper angle of the contact portion 31 is not necessarily the same to that of the tapered hole, and furthermore the contact portion 31 is terminated at the cylindrical straight shape.

Moreover, the end of the torsion spring 40 can not be necessarily held by the position determination pin 30, and instead it can be held by any other portions of the shoe housing 12.

In addition, a plurality of position determination members can be used.

Furthermore, the groove 24 can be formed not in the sprocket 14 but in the shoe 121, or the grooves can be formed both in the sprocket and the shoe 121, to form the connection hole 25.

Furthermore, the present invention can be used to any other apparatus than the above mentioned valve timing adjusting apparatus. Namely, the invention can be used to a hydraulic system, in which one member is positioned to another member by a position determination means.

What is claimed is:

1. A valve timing adjusting apparatus for an internal combustion engine comprising:

a housing unit having a shoe housing, a front plate and a sprocket, the shoe housing having multiple shoes inwardly projecting from an outer periphery of the shoe housing, the shoe housing being interposed between the front plate and the sprocket to form multiple accommodation chambers circumferentially between the adjacent shoes, and the sprocket being rotated by an engine;

a vane rotor having multiple vanes respectively accommodated in the accommodation chambers to divide the same into a retarding chamber and an advancing chamber, the vane rotor being rotationally housed in the housing unit so that the vane rotor is rotatable with respect to the housing unit within a limited angle, the vane rotor being connected to a cam shaft of the engine, so that a rotation of the housing unit is transmitted to the cam shaft through the vane rotor with a rotational phase retarded or advanced depending on the position of the vane rotor to the housing unit;

a torsion spring connected to the housing unit at its one end and to the vane rotor at the other end, to urge the vane rotor in an advancing direction;

a stopper piston received in one of the vanes in a reciprocating manner in an axial direction of the vane rotor;

a bush formed in the sprocket, into which a forward end of the stopper piston is inserted when the rotor vane is held at its most advanced position;

a through hole formed in one of shoes, through which a position determination pin is inserted;

a bottomed hole formed in the sprocket into which a forward end of the position determination pin is inserted to position the shoe housing with respect to the sprocket, wherein the bottom hole has a tapered hole, an opening of which faces to an end of the through hole of the shoe and has a larger diameter than that of the through hole, and wherein the forward end of the position determination pin comes in contact with the tapered hole.

2. A valve timing adjusting apparatus according to claim 1, wherein the forward end of the position determination pin is formed into a taper shape having a taper angle almost equal to that of the tapered hole.

3. A valve timing adjusting apparatus according to claim 2, wherein a generating line of the forward end is shorter than that of the tapered hole.

4. A valve timing adjusting apparatus according to claim 1, wherein a component force generated at a contact point between the forward end of the position determination pin and the tapered hole urges the shoe housing in a retarding direction with respect to the sprocket.

5. A valve timing adjusting apparatus according to claim 1, wherein the position determination pin is press fitted into the through hole of the shoe.

6. A valve timing adjusting apparatus according to claim 1, further comprising:

a connection hole formed between the shoe housing and the sprocket for communicating a space formed by the tapered hole with the accommodation chamber.

* * * * *